US005676328A

United States Patent [19]

Threlkeld et al.

[11] Patent Number: 5,676,328

[45] Date of Patent: Oct. 14, 1997

[54] METHOD AND APPARATUS FOR CONTROLLING TENSION IN A TRAVELING STRAND OF RUBBER YARN DURING TRAVERSE WINDING

[76] Inventors: James O. Threlkeld; Thor Robert Thisse, both of 4100 Barringer Dr., Charlotte, N.C. 28217

[21] Appl. No.: 614,633

[22] Filed: Mar. 13, 1996

[51] Int. Cl.[6] ..... B65H 59/38; B65H 62/00; B65H 51/00

[52] U.S. Cl. ..... 242/413.5; 242/36; 242/47 R; 242/418.1

[58] Field of Search ..... 242/36, 18 R, 242/47 R, 413.1, 413.3, 413.4, 413.5, 418.1

[56] References Cited

U.S. PATENT DOCUMENTS

| | | | |
|---|---|---|---|
| 2,432,876 | 12/1947 | Formhals et al. | 242/413.5 X |
| 3,592,400 | 7/1971 | Gith | 242/36 |
| 3,801,031 | 4/1974 | Kamp et al. | 242/36 |
| 3,931,938 | 1/1976 | Hasegawa et al. | 242/413.5 X |
| 4,214,717 | 7/1980 | Makino et al. | 242/36 |
| 4,500,043 | 2/1985 | Brown | 242/413.3 |
| 4,880,175 | 11/1989 | Yamauchi et al. | 242/36 X |
| 5,074,481 | 12/1991 | Kathke | 242/36 |
| 5,547,138 | 8/1996 | Claut et al. | 242/36 |

*Primary Examiner*—Michael Mansen
*Attorney, Agent, or Firm*—Shefte, Pinckney & Sawyer

[57] ABSTRACT

An apparatus for controlling the tension on a traveling strand of rubber yarn being wound on a winder includes the yarn guide defining three yarn passage regions, a first assembly for detecting the presence of the traveling strand in the second region, and providing an output as a response and a second assembly for detecting the presence of the traveling strand in the third region and providing an output as a response thereto. The apparatus further includes an arrangement for adjusting the tension on the traveling strand responsive to input from the yarn detectors.

12 Claims, 4 Drawing Sheets

METHOD AND APPARATUS FOR CONTROLLING TENSION IN A TRAVELING STRAND OF RUBBER YARN DURING TRAVERSE WINDING

BACKGROUND OF THE INVENTION

The present invention relates broadly to apparatus for controlling tension in traveling strands of yarn on a winder and, more specifically, to an apparatus for controlling tension in a traveling strand of rubber yarn being wound on a winder.

Due to the nature of rubber yarn, and most elastomerics, package winding can be a difficult task to perform well. The obvious distinction between elastomeric yarn and other types of yarn is that the elastomeric yarn will stretch under tension. Therein lies the problem, since yarn tension is a fundamental aspect of package winding. Tension control becomes more critical when dealing with elastomeric yarns than with conventional yarns.

In conventional yarn winding, tension is maintained at some predetermined level for a neat package wind. If such tension were maintained when winding elastomerics, the result would be disastrous. The yarn would be wound on a package under tension and the yarn package would be filled with yarn under various levels of tension. By way of example, FIG. 2 illustrates a properly wound yarn package while FIG. 3 illustrates a yarn package which has been wound with too much tension. After several hundred winds, the internal tension builds to such a degree that it can completely collapse a core and result in a totally unusable package as seen in FIG. 3. Another problem which arises when using natural rubber yarn is that the rubber yarn can actually fuse together inside a tightly-wound package, thereby rendering the yarn completely unusable due to its inability to be unwound.

The proper tension to maintain when winding natural rubber yarn or other elastomerics is some value slightly above zero which can be described as "shades of zero". The value is not exactly zero, for then there would be no yarn travel. Further, the tension cannot be negative because then the yarn would be traveling in the opposite direction, i.e., unwinding. Therefore, yarn tension must be maintained at some value slightly greater than zero. This value cannot be measured directly using conventional equipment due to the sensitivity required. Therefore, there exists a need to determine the tension of a traveling strand of rubber yarn being wound on a winder, to maintain the tension at a value slightly greater than zero.

SUMMARY OF THE INVENTION

It is accordingly an object of the present invention to provide an apparatus and method for controlling the tension on a traveling strand of rubber yarn.

It is another object of the present invention to provide an apparatus for indirectly measuring the tension on a traveling strand of rubber yarn and correcting the tension responsive to the indirect measurement.

It has been observed that when winding rubber yarn on a winder, the directional change of the traverse occurring at either end of the yarn package causes the rubber yarn to whip, or form a bow shape in a region intermediate the final capstan, or spool, and the yarn package itself.

To that end, the apparatus for controlling tension on a traveling strand of rubber yarn being wound on a winder is disposed on the winder adjacent a yarn package spindle of the winder with the tension and control apparatus including means for defining a first yarn passage region, a second yarn passage region, and a third yarn passage region with the traveling strand being required to pass through any one of the three regions. A first assembly is provided for detecting the presence of the traveling strand with the first detection assembly being disposed for detection of the traveling strand within the second yarn passage region. A second assembly is also provided for detecting the presence of a traveling strand with the third yarn passage region. The present invention further includes an arrangement for adjusting tension on the traveling strand responsive to input from the first assembly for detecting the presence of the traveling strand and the second assembly for detecting the presence of the traveling strand.

It is preferred that the arrangement for defining the regions includes a yarn guide member for deflecting the traveling strand into one of the regions so defined. Preferably, the assembly for adjusting tension on the traveling strand includes an assembly for increasing the yarn tension responsive to input from the second detection assembly indicating that the yarn is passing through the third region. It is further preferred that the assembly for adjusting tension on the traveling strand includes an assembly for decreasing the yarn tension responsive to the absence of input from the first yarn detection assembly and the second yarn detection assembly indicating the yarn is passing through the first region. It is preferred that the arrangement for adjusting tension on the traveling strand includes an assembly for selectively increasing and decreasing a rotational speed of the winder. It is preferable that the first assembly for detecting the presence of the traveling strand include a photocell configured and disposed to produce an electrical output signal whenever the traveling strand is passing across the photocell. It is further preferred that the second assembly for detecting the presence of the traveling strand also include a photocell configured and disposed to produce an electrical output signal whenever the strand is passing thereacross.

Preferably, the first detection assembly emits a signal when the traveling strand passes through the second yarn passage region and both the first detection assembly and the second detection assembly emit a signal when the traveling strand is passing through the third region and no signal is emitted from either the first detection assembly or the second detection assembly when the traveling strand is passing through the first region. This indicates that when the traveling strand is passing through the first region, the tension on the traveling strand is greater than a first threshold value, when the traveling strand is passing through the second region, the tension on the traveling strand is within acceptable range of tension values, and when the traveling strand is passing through the third region, the tension on the traveling strand is less than a second threshold value.

The present invention also includes a method for controlling the tension on a traveling strand of rubber yarn being wound on a winder. The method includes the steps of providing the above-discussed equipment and defining a first yarn passage region, a second yarn passage region, and a third yarn passage region using the yarn guide assembly with a traveling strand being required to pass through any one of the regions. The method further includes the steps of detecting the presence of the yarn in one of the first yarn passage region, the second yarn passage region, and the third yarn passage region, and adjusting tension on the traveling strand responsive to input from the first assembly for detecting the presence of the traveling strand and the second assembly for detecting the presence of the traveling strand.

The method step of detecting the presence of the yarn in one of the yarn passage regions preferably includes the emission of a signal by the first detection assembly when the traveling strand passes through the second yarn passage region and the emission of a signal from both the first and second detection assemblies when the traveling strand is passing through the third region and the emission of no signal from either the first detection assembly or the second detection assembly when the traveling strand is passing through the first region. This indicates that when the traveling strand is passing through the first region, the tension on the traveling strand is greater than a first threshold value and when the traveling strand is passing through the second region, the tension on the traveling strand is within an acceptable range and when the traveling strand is passing through the third region, the tension on the traveling strand is less than a second threshold value.

DESCRIPTION OF THE PREFERRED EMBODIMENT

Figure 1:
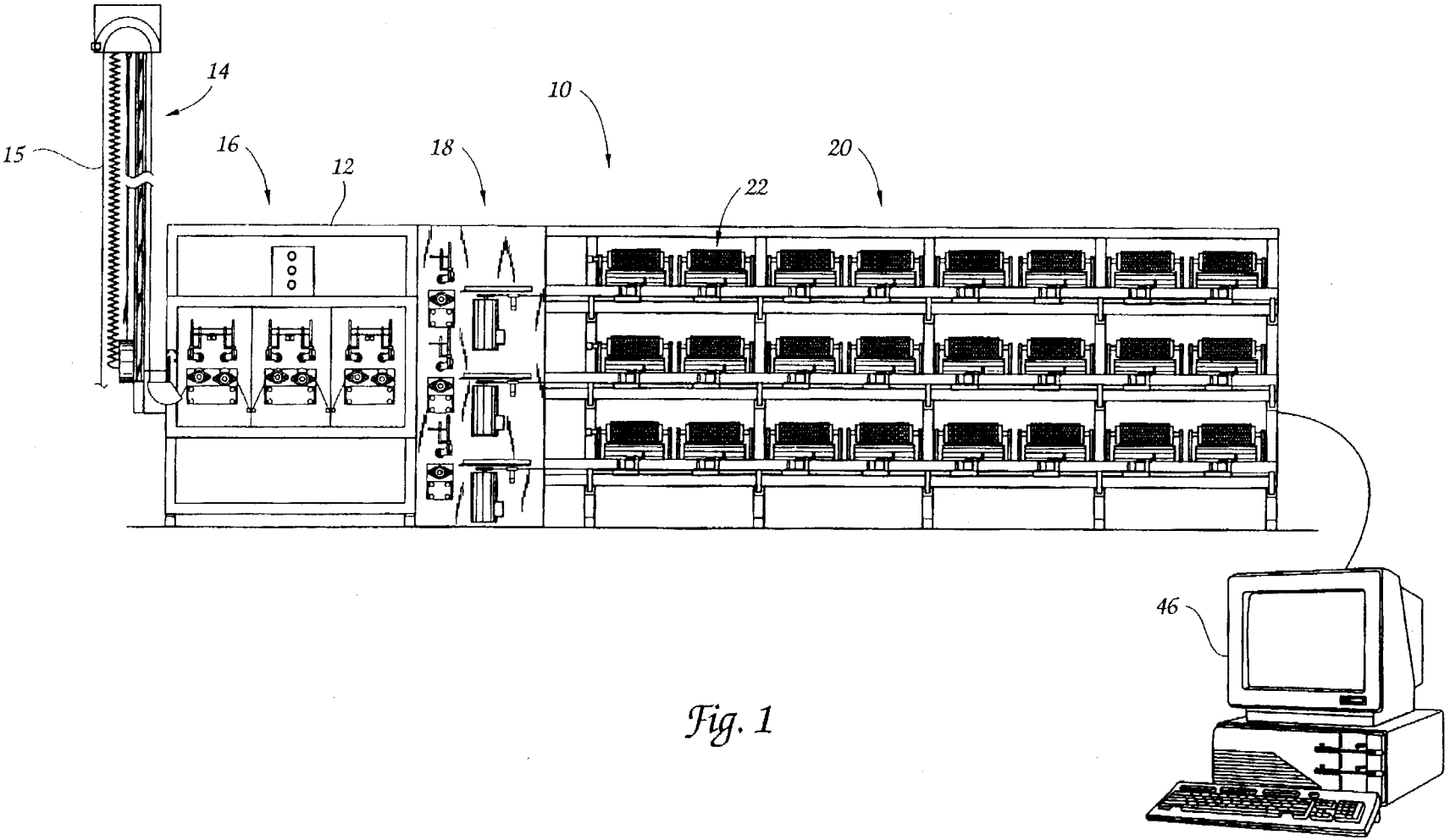
FIG. 1 is an elevational view of a rubber yarn winder utilizing the method and apparatus according to the preferred embodiment of the present invention.
Figure 2:
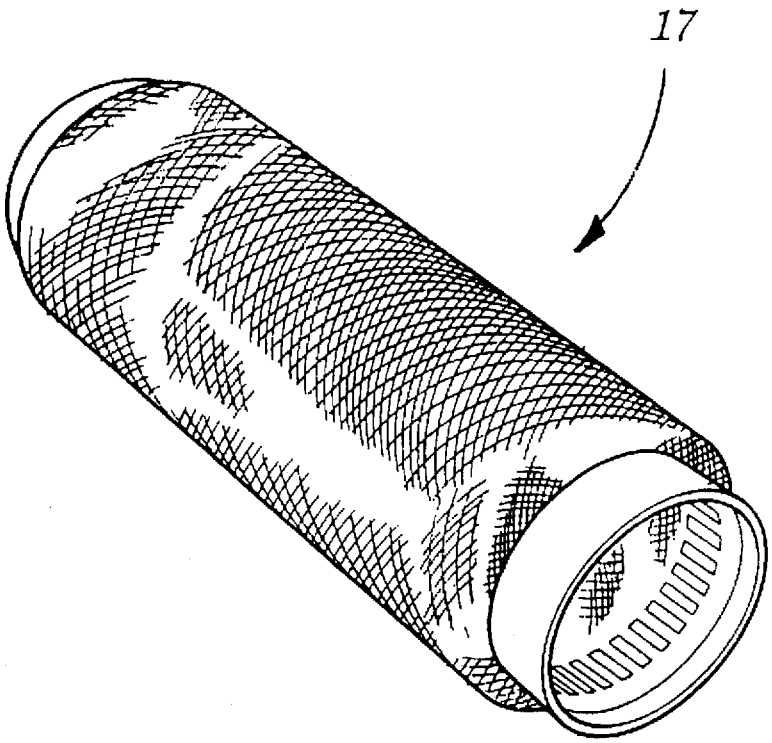
FIG. 2 is a perspective view of a properly wound yarn package.
Figure 3:
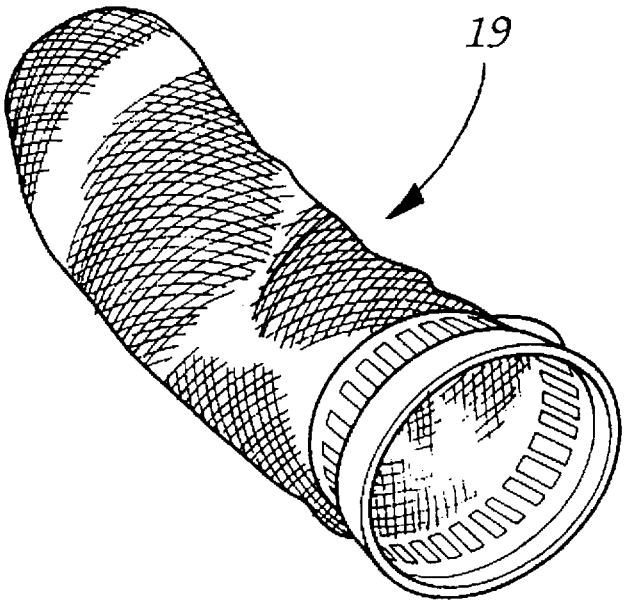
FIG. 3 is a perspective view of a yarn package wound with improper tension illustrating the resultant damage.

Turning now to the drawings, and more particularly to FIG. 1, a winder for winding rubber yarn in packages is illustrated generally at 10 and includes a skeletal frame 12 housing several key components. A yarn support member 14 is formed as an elongate tower-like member disposed at one end of the skeletal frame 12. A yarn stretching apparatus 16 is disposed downstream of the support 14 and is also mounted to the frame 12. A yarn/tractor distribution apparatus 18 is also mounted to the frame 12 and is disposed downstream from the yarn stretching assembly 16. From the yarn distribution assembly, the yarn extends to one of twenty-four traverse mechanisms 22 disposed in a traverse section 20 of the frame 12. The apparatus is configured for control by a microcomputer 46. The winder 10 is dedicated to winding elastomeric yarn including natural rubber yarn and spandex. As was discussed previously, the result of the problem to which the present invention is directed is illustrated in FIG. 3. There, a yarn package 19 has been crushed due to internal tension. Further, and is not apparent from the surface, internal yarn portions may be fused together such that the package becomes unusable. A properly wound yarn package is illustrated at 17 in FIG. 2. In order to prevent such complete destruction of the yarn package as illustrated in FIG. 3, the present invention provides a measure of control over the tension of the elastomeric yarn being wound and, therefore, ensures a good yarn package.

Figure 4:
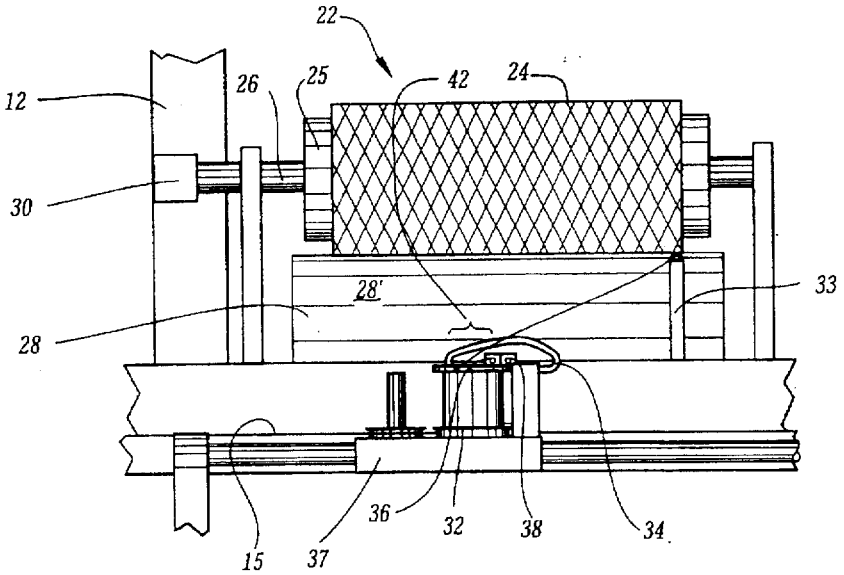
FIG. 4 is an elevational view of a traverse winder portion of the winding machine illustrated in FIG. 1 showing the yarn in the second region, under proper tension.
Figure 5:
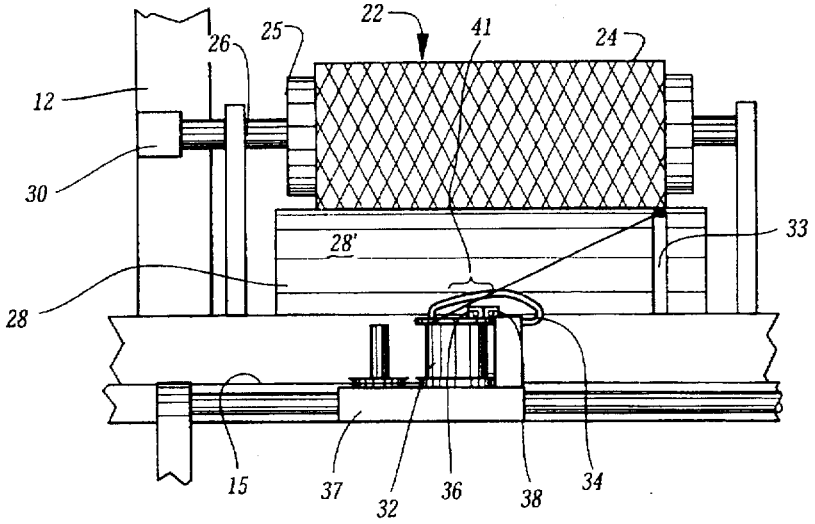
FIG. 5 is a perspective view of the traverse winder illustrated in FIG. 4 showing the yarn in the first region under improper tension.
Figure 6:
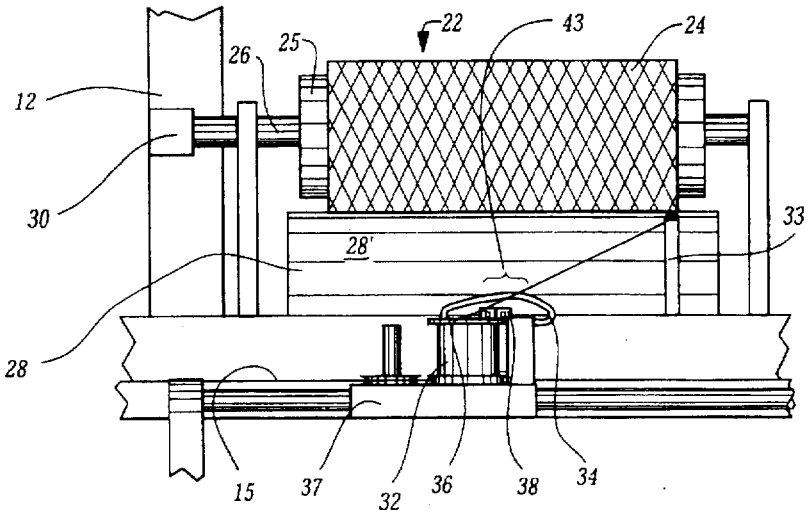
FIG. 6 is an elevational view of the traverse winder illustrated in FIG. 5 showing the yarn passing through the third region, indicating that the yarn is under insufficient tension.

Turning now to any one of FIGS. 4–6, the traverse winding mechanism is illustrated generally at 22 and includes a generally cylindrical yarn package 24 rotatably mounted to a spindle 26 which is in turn mounted to journals 30 which are themselves mounted to the frame 12. Thereby, and as is appreciated by those skilled in the art, the yarn package 24 is freely rotatable with respect to the frame 12. Since the present invention is used with a surface winder, a drive roll 28 having a traction surface 28' formed thereon is rotatably mounted to the frame 12 and is driven by motors (not shown). The drive motors are controlled by the microcomputer 46 as seen in FIG. 1, a in known manner.

A traverse mechanism is employed to direct the thread onto the yarn package in an orderly manner. The traverse mechanism (not shown) acts to move a generally narrow, elongate yarn directing arm 33 back and forth in synchronization with the rotation of the spindle 26 which is in turn induced by the drive roll 28 through surface contact with the package 24 being wound. A yarn support capstan 32 is rotatably mounted to a bracket 37 which is in turn mounted to the frame 12. The capstan 32 is a cylindrical member disposed centrally with respect to the traverse ends. As shown in FIGS. 4, 5, and 6, a yarn strand 15 is shown wrapped several times around the capstan 32 and extends therefrom to the traverse arm 33 where it is threaded therethrough and from there enters the yarn package 24. As previously noted, yarn strand 15 extends across an open space between the capstan 32 and the traverse arm 33.

The use of the capstan 32 also provides a specific debarkation point for the yarn strand 15 to cross the space to the traverse arm 33. Therefore, the yarn strand 15 should experience constant tension between the capstan 32 and the traverse arm 33, whatever that tension may be.

The apparatus for monitoring the tension in the traveling strand 15 is disposed within the space between the capstan 32 and the traverse arm 33. All of the components of the monitoring apparatus are mounted to the frame 12 and include a yarn guide member 34 which is formed with a heavy wire as a somewhat flattened oval with a flat, sloping side. The yarn guide 34 is disposed under the traveling strand 15 such that the traveling strand 15 is deflected into one of three regions by the yarn guide 34. As best seen in FIG. 5, two photocells 36,38 are mounted in a side-by-side relationship beneath the yarn guide 34. The photocells 36,38 are configured for the emission of an electrical signal which is fed to the control microcomputer 46 through conventional control lines (not shown). Operation of signal emitting photocells and use of their signals in an electrical sense is well within the knowledge of those skilled in the art and will not be explained in great detail herein.

The positioning of the photocells 36,38 in relation to the yarn guide 34 defines three yarn passage regions. In FIG. 5, a first yarn passage region 41 is defined as that amount of free space from one end of the yarn guide 34 to the first photocell 36. As seen in FIG. 4, a second yarn passage region 42 is defined as that area of free space directly over the first photocell 36. Finally, a third yarn passage region 43 is illustrated in FIG. 6 and is defined as that area of free space from the junction of the two photocells 36,38 outwardly in a direction toward the end of the yarn package. As a consequence, when the yarn passes through the first yarn passage region, as seen in FIG. 5, the two photocells 36,38 are not triggered because no yarn is passing thereacross. In FIG. 4, the yarn is passing through the second yarn passage region 42 and thusly across the first photocell 36 with no portion of the yarn extending over the second photocell 38. Therefore, the first photocell 36 emits a signal while the output of the second photocell 38 remains null. Finally, in FIG. 6, the yarn 15 is passing through the third yarn passage region 43 and, as such, is crossing beth photocells 36,38 such that beth photocells 36,38 emit a signal. As a consequence, the control microcomputer 46 senses one of three conditions as will be explained more fully below.

In operation, the rubber, spandex, or other elastomeric yarn is threaded onto the winder in a manner illustrated in FIG. 1 and the winder activated. With reference to FIGS. 4, 5, and 6, it will be appreciated by those skilled in the surface winding art the yarn package 24 is wound on the core 25 and the drive roll 28 is caused to rotate which causes the core 25 to rotate through frictional contact between the respective surfaces thereof. While the drive roll 28 rotates the yarn package 24, the traverse arm 33 is caused to move laterally with respect to the yarn package 24 to direct the yarn onto the package 24 in a helical line. As the traversing arm 33 reaches the end of its travel path, it must completely stop and reverse direction to once again traverse the yarn package 24. At that instant when the traverse arm stops and changes direction, the momentum of the yarn segment intermediate the capstan 32 and the traversing arm 33, in combination with the ability of the yarn 15 to stretch longitudinally, creates a whipping action in the yarn segment which causes the yarn to bow outwardly. The whipping action takes place for an instant when the traverse arm 33 changes direction and the wind continues. The extent of the whipping action, or the magnitude of the radius of the bow, is directly proportional to the amount of tension on the yarn created by the pull of the winding assembly. The force exerted by the winding assembly is proportional to the speed at which the package 24 is driven relative to the restraining force imposed on the upstream yarn 15. The apparatus of the present invention, while not actually measuring the radius to obtain a value, acts to determine whether the radius is in one of three ranges as defined by the three regions.

Therefore, as the yarn is being wound, if the yarn whips through only the first region, thereby activating no photocells 36,38, the yarn is considered to be under excess tension and, due to the absence of signals from the photocells 36,38, the control microcomputer 46 slows the drive roll 28 to relax tension on the strand 15. This condition is illustrated in FIG. 5.

With reference to FIG. 6, if the strand 15 whips outwardly into the third region 43, both photocells 36,38 emit signals to the microcomputer 46 which, when faced with such a signal combination, senses that the yarn 15 is not under enough tension and speeds the drive roll 28 thereby increasing the tension.

FIG. 4 illustrates the yarn 15 transiting the second yarn passage region, activating the first photocell 36 while the second photocell 38 remains electrically silent. This condition is sensed by the computer as being normal and no adjustment is necessary to the drive roll speed. As may be appreciated, when the yarn is in the condition shown in FIG. 4, that is under normal tension, a slight whipping action occurs. This means that the yarn is under a tension which is what was previously referred to as a "shade of zero". That is, the yarn is being wound and continually traveling to the winder under a tension that is very slight.

By the above, the present invention avoids the dual problems of collapsed cores and fused yarn typically associated with a yarn package of natural rubber yarn, spandex, or other elastomeric yarn wound too tight. The apparatus of the present invention automatically maintains the tension at a proper level and, with reference to FIG. 1, one of the twenty-four traverse mechanisms maybe fitted with the tension monitoring apparatus and all twenty-four traverse mechanisms 22 are controlled by a master tension value. Since the traveling yarn is wound from a tape of fused, individual yarn strands, all twenty-four traverse winders should be operating at the same speed so that the yarn is not unduly stretched during winding. Therefore, only one monitoring apparatus is needed for the entire winding operation illustrated in FIG. 1.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An apparatus for controlling tension on a traveling strand of rubber yarn being wound on a traverse winder, said tension control apparatus being disposed on the winder adjacent a yarn package spindle thereof, said tension control apparatus comprising:

means for guiding the yarn, said yard guide means defining a first yarn passage region, a second yarn passage region and a third yarn passage region, said traveling strand being required to undergo traversing movement and thereby make repeated passes through at least one of said three regions during traverse winding;

first means for detecting the presence of the traveling strand during traversing movement thereof and providing an output in response thereto, said first detection means being disposed for detection of the traveling strand within said second yarn passage region, second means for detecting the presence of the traveling strand during traversing movement thereof and providing an output in response thereto, said second detection means being disposed for detection of the traveling strand within said third yarn passage region, and means for adjusting tension on the traveling strand responsive to the condition of said outputs from said first means for detecting the presence of the traveling strand and said second means for detecting the presence of the traveling strand.

2. An apparatus for controlling the tension on a traveling strand of rubber yarn according to claim 1 wherein said means for defining said regions includes a yarn guide member for deflecting the traveling strand into one of said regions.

3. An apparatus for controlling the tension on a traveling strand of rubber yarn according to claim 1 wherein said means for adjusting tension on the traveling strand includes means for increasing the yarn tension responsive to an output condition from said second detection means indicating the yarn is passing through the third region.

4. An apparatus for controlling the tension on a traveling strand of rubber yarn according to claim 1 wherein said means for adjusting tension on the traveling strand includes means for decreasing the yarn tension responsive to the absence of output from said first yarn detection means and said second yarn detection means indicating the yarn is passing through the first region.

5. An apparatus for controlling the tension on a traveling strand of rubber yarn according to claim 1 means for adjusting tension on the traveling strand includes means for selectively increasing and decreasing a rotational speed of the winder to thereby increase or decrease tension on the traveling strand.

6. An apparatus for controlling the tension on a traveling strand of rubber yarn according to claim 1 wherein said first means for detecting the presence of the traveling strand includes a photocell configured and disposed to produce an electrical output signal whenever the traveling strand is passing across said photocell.

7. An apparatus for controlling the tension on a traveling strand of rubber yarn according to claim 1 second means for detecting the presence of the traveling strand includes a photocell configured and disposed to produce an electrical output signal whenever the traveling strand is passing across said photocell.

8. An apparatus for controlling the tension on a traveling strand of rubber yarn according to claim 1 wherein said first detection means includes means for emitting a signal when the traveling strand passes through said second yarn passage region, said signal being indicative that the tension on the traveling strand is within a predetermined range, and both said first detection means and second detection means include means for emitting a signal when the traveling strand is passing through said third region, said signal being indicative that the tension on the traveling strand is greater than an upper limit of the predetermined range, and said first detection means and said second detection means both include means for withholding signal emission when the traveling strand is passing through said first region, said withholding of signal emission being indicative that the tension on the traveling strand is less than a lower limit of the predetermined range.

9. A method for controlling tension on a traveling strand of rubber yarn being wound on a traverse winder, said tension control apparatus being disposed on the winder adjacent a yarn package spindle thereof, said method comprising the steps of:

providing means for guiding the yarn, said yarn guide means defining a first yarn passage region, a second yarn passage region and a third yarn passage region, said traveling strand being required to undergo traversing movement and thereby make repeated passes through at least one of said three regions during traverse winding;

providing first means for detecting the presence of the traveling strand during traversing movements thereof and providing an output in response thereto, said first detection means being disposed for detection of the traveling strand within said second yarn passage region, providing second means for detecting the presence of the traveling strand during traversing movement thereof and providing an output in response thereto, said second detection means being disposed for detection of the traveling strand within said third yarn passage region, providing means for adjusting tension on the traveling strand responsive to the condition of said outputs from said first means for detecting the presence of the traveling strand and said second means for detecting the presence of the traveling strand;

detecting the presence of the traveling strand in one of said first yarn passage region, a second yarn passage region and a third yarn passage region;

adjusting tension on the traveling strand responsive to the condition of said outputs from said first means for detecting the presence of the traveling strand and said second means for detecting the presence of the traveling strand.

10. A method for controlling the tension on a traveling strand of rubber yarn according to claim 9 wherein the step of providing said first means for detecting the presence of the traveling strand includes providing a photocell configured and disposed to produce an electrical output signal whenever the traveling strand is passing across said photocell.

11. A method for controlling the tension on a traveling strand of rubber yarn according to claim 9 wherein the step of providing said second means for detecting the presence of the traveling strand includes a photocell configured and disposed to produce an electrical output signal whenever the traveling strand is passing across said photocell.

12. A method for controlling the tension on a traveling strand of rubber yarn according to claim 9 wherein the step of detecting the presence of said yarn in at least one of said first yarn passage region, said second yarn passage region and said third yarn passage region includes the emission of a signal by said first detection means when the traveling strand passes through said second yarn passage region indicating that the tension on the strand is within a predetermined range and emission of a signal from both said first detection means and second detection means when the traveling strand is passing through said third region indicating that the tension on the strand is less than a lower limit of the predetermined range and the emission of no signal from either said first detection means or said second detection means when the traveling strand is passing through said first region indicating that the tension on the traveling strand is greater than an upper limit of the predetermined range.

* * * * *

UNITED STATES PATENT AND TRADEMARK OFFICE

CERTIFICATE OF CORRECTION

PATENT NO. : 5,676,328

DATED : October 14, 1997

INVENTOR(S) : James O. Threlkeld and Thor Robert Thisse

It is certified that error appears in the above-identified patent and that said Letters Patent is hereby corrected as shown below:

Column 5, line 3, delete "beth" and insert -- both --

Column 5, line 4, delete "beth" and insert -- both --

Column 6, line 1, delete "maybe" and insert -- may be --

Column 6, line 36, delete "said yard" and insert -- said yarn --

Column 7, line 9, after "claim 1" insert -- wherein said --

Column 7, line 21, after "claim 1" insert -- wherein said --

Signed and Sealed this

First Day of December, 1998

*Attest:*

Bruce Lehman

BRUCE LEHMAN

*Attesting Officer*

*Commissioner of Patents and Trademarks*